US006309431B1

(12) United States Patent
Becker et al.

(10) Patent No.: US 6,309,431 B1
(45) Date of Patent: Oct. 30, 2001

(54) WINTERIZED PARAFFIN CRYSTAL MODIFIERS

(75) Inventors: Harold L. Becker, Tomball; Dora Galvan, Houston, both of TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 09/454,142

(22) Filed: Dec. 3, 1999

Related U.S. Application Data

(60) Provisional application No. 60/111,034, filed on Dec. 4, 1998.

(51) Int. Cl.[7] ..... C10L 1/18

(52) U.S. Cl. ..... 44/393; 44/397; 44/445; 44/447; 44/448; 44/451

(58) Field of Search ..... 44/393, 397, 447, 44/448, 451, 445

(56) References Cited

U.S. PATENT DOCUMENTS

| | | | | |
|---|---|---|---|---|
| 3,642,609 | | 2/1972 | Mayer et al. | 208/33 |
| 3,779,894 | | 12/1973 | Eagen et al. | 208/33 |
| 3,792,983 | | 2/1974 | Tunkel et al. . | |
| 3,883,318 | | 5/1975 | Feldman et al. . | |
| 3,999,960 | | 12/1976 | Langer, Jr. et al. . | |
| 4,014,663 | | 3/1977 | Feldman et al. . | |
| 4,846,847 | * | 7/1989 | Nelson, Jr. et al. | 44/393 |
| 4,882,034 | | 11/1989 | Tack et al. | 208/15 |
| 5,425,789 | | 6/1995 | Lewtas et al. | 44/391 |
| 5,674,300 | | 10/1997 | McAleer et al. | 44/459 |

OTHER PUBLICATIONS

SPE 56811, "Winterized Paraffin Crystal Modifiers" by J.R. Becker, presented at the 1999 SPE Annual Technical Conference and Exhibition held in Houston, Texas; Oct. 3–6, 1999.

* cited by examiner

*Primary Examiner*—Margaret Medley
*Assistant Examiner*—Cephia D. Toomer
(74) *Attorney, Agent, or Firm*—Howrey Simon Arnold & White

(57) ABSTRACT

Winterized wax crystal modifiers which remain fluid at temperatures ranging from about −40° F. to 160° F. and methods for winterizing wax crystal modifiers are provided.

19 Claims, No Drawings

WINTERIZED PARAFFIN CRYSTAL MODIFIERS

This application claims the benefit of U.S. Provisional Application Ser. No. 60/111,034 filed Dec. 4, 1998.

FIELD OF THE INVENTION

The present invention relates generally to winterized wax crystal modifiers and their use in inhibiting or retarding the formation of wax crystal precipitates in petroleum fuel and crude oil at cold temperatures.

BACKGROUND OF THE INVENTION

Petroleum fuels and crude oils contain normal paraffin hydrocarbon waxes which tend to precipitate and crystallize at low temperatures, causing oil to lose its fluidity. Over a range of temperatures, these paraffin wax crystals continue to aggregate and can solidify the oil. This creates difficulties in transporting the petroleum fuel or crude oil through flow lines, valves, and pumps. Paraffin wax crystals are particularly problematic at lower temperatures and in colder climates where, as the temperature drops and approaches the crude oil's pour point, the transportation of crude oil becomes more difficult. Pour point is defined by the ASTM method D-97 as "the lowest temperature at which the crude oil will still flow when it is held in a pour point tube at ninety degrees to the upright for five seconds." Paraffin wax crystals that have come out of solution also tend to plug flow lines, production tubing, flow lines, screens and filters.

This problem is well recognized, and various additives known as pour point depressants and wax crystal modifiers have been used to change the nature of the crystals that precipitate from the petroleum fuel or crude oil, thereby reducing the tendency of the wax crystals to set into a gel. Generally, wax crystal modifiers possess long segments of repeating saturated carbon chain groups ($C_{20}H_{41}$—$C_{50}H_{101}$) that are contained in or attached to a polymer backbone. These compositions, which are slightly soluble in highly aromatic solvents such as toluene, xylene and heavy aromatic naphtha at moderate temperature (i.e., 68° F.), are added to the petroleum fuel or crude oil to be treated. Typically, these crystal modifiers slowly co-crystallize with the paraffin waxes already present in the petroleum fuel or crude oil and effect morphological changes that retard further crystal growth. However, many of the standard crystal modifiers that are known in the art solidify at temperatures ranging from 30° F. to 140° F. Thus many of the crystal modifiers that are presently available are not particularly useful in the field at cold temperatures or under winter conditions.

SUMMARY OF THE INVENTION

The present invention is directed to wax crystal modifiers which remain fluid and pumpable at temperatures ranging from about −40° F. to 160° F. and their use in inhibiting or retarding the formation of wax crystal precipitates in petroleum fuels and crude oils at cold temperatures. The invention is particularly useful for treating petroleum fuels in cold climates and under winter conditions where standard wax crystal modifiers known in the art solidify at temperatures ranging from 30° F. to 140° F. Polymeric wax crystal modifiers useful in the present invention generally include acrylates and methacrylates with pendant groups of C10 to C50, as well as polymers with long repeating saturated carbon chain segments such as ethylene vinyl acetate copolymers. The wax crystal modifiers are added to and dissolved in a bipolar solvent or solvent mixture at elevated temperatures, then cooled with vigorous mixing to form a suspension of finely divided wax crystal modifier polymer particles. Alternatively, a high polarity solvent (or solvents) may also be added to help develop the polymeric suspension. When the wax crystal modifier suspension is added to petroleum fuel or crude oil by pumping or other mechanical means, the formation of paraffin wax crystals is disrupted, thereby retarding the formation of wax crystal precipitates that often impede the flow and transportation of crude oil through tubing, flow lines and pumps.

DETAILED DESCRIPTION

This application claims the benefit of U.S. Provisional Application Ser. No. 60/111,034 filed Dec. 4, 1998.

The present invention provides wax crystal modifiers suspended in bipolar solvate systems that are effective in retarding the formation of paraffin crystal precipitates, while remaining fluid over a range of temperatures from −40° F. to 160° F. Also provided are methods of winterizing or freeze protecting wax crystal modifiers and methods of inhibiting the formation of paraffin wax crystal precipitates in petroleum fuel or crude oil. In general, polymeric wax crystal modifiers are added to and dissolved in bipolar solvents or solvent mixtures that comprise a range of solubility parameters, hydrogen bonded characteristics, and densities that are necessary for the formation of highly dispersed and finely divided polymer particles that are stable as suspensions at the desired temperatures. The wax crystal modifiers of the present invention are highly advantageous in that they remain pumpable at temperatures well below freezing, unlike wax crystal modifiers known in the art which become solid at temperatures of about 30° to 140° F.

Polymeric wax crystal modifiers that are useful for practicing the present invention include acrylates and methacrylates with pendant groups of C10 to C50, as well as polymers with long repeating saturated carbon chain segments such as ethylene vinyl acetate (EVA) copolymers. These include but are not limited to acrylate or methacrylate esters of long chain alcohols, long chain alcohol esters of maleic acid, long chain fatty acid esters of acrylate and methacrylate polymers, maleic olefin alkyl esters, and ethylene vinyl acetate polymers of varying molecular weights. Copolymers, terpolymers and tetrapolymers are also contemplated. Preferred wax crystal modifiers include ethylene vinyl acetate copolymers, maleic olefin alkyl esters, acrylate esters, methacrylic esters, and mixtures thereof.

In general, polymeric wax crystal modifiers are solvated in a bipolar solvent or solvent mixture at elevated temperatures ranging from 150° to 350° F. The polymer/solvent mixture is then allowed to cool to ambient temperature with vigorous mixing. In a preferred embodiment, a high polarity solvent is added to the polymer/solvent mixture, generally during the cooling phase, to form a suspension. Alternatively, the high polarity solvent may be added to the polymer/solvent mixture before or during the heating phase. The use of a high polarity solvent is not always required. Surfactants and suspending agents may also be added but are not critical to the invention. The resulting suspension of finely divided wax crystal modifier particles remains fluid and pumpable at temperatures ranging from −40° F. to 160° F. When the wax crystal modifier suspension is added to petroleum fuel or crude oil by pumping or other mechanical means, the formation of paraffin wax crystals is disrupted. In effect, the wax crystal modifiers of the present invention change the morphology of the paraffin crystals that are already present in the petroleum fuel or crude oil and retard further crystal growth, altering the crystallization point of the petroleum fuel or crude oil that is being treated.

Alternatively, polymeric wax crystal modifiers are first solvated in a nonpolar aliphatic solvent or solvent mixture with mixing and heating to form a solution. Aliphatic solvents useful for practicing the invention include kerosene, KERMAC 600 (petroleum hydrocarbon distillate, commercially available from Calumet Lubricants Co.), and other low aromatic paraffinic solvents. Generally, the polymer/aliphatic solvent mixture is heated to a temperature above the melting point of the polymers. The solvent is then extracted by the addition of a bipolar solvent such as isopropyl alcohol with vigorous mixing to disperse the polymer particles.

It is believed that when the polymeric wax crystal modifiers are mixed with the bipolar solvent or solvent mixture, the polar segments of the crystal modifier(s) associate with the polar ends of the bipolar solvent, while the non-polar segments of the crystal modifier(s) associate with the non-polar segments of the bipolar solvent. This association is commonly referred to as micellarization, or the formation of particles of sufficiently small size to produce a stable suspension of solid polymer within a non-solvent or poorly solvating external fluid. The resulting micellar system or particle suspension is then further separated by the addition of a high polarity solvent and vigorous mixing and cooling, which effectively develops or fixes the micellar mixture such that it remains as a stable suspension.

Bipolar solvents consisting of polar (i.e., ethylene oxide adducts of linear alcohol) and non-polar (i.e., aliphatic alkyl groups) groups are generally used to dissolve the polymeric wax crystal modifiers at elevated temperatures ranging from 150° to 350° F. Typically, the polymer/solvent mixture is heated with mixing to a temperature above the melting point of the polymer(s) to effect dissolution of the polymer. Bipolar solvents useful for practicing the invention generally include but are not limited to alcohols, ethoxylated alcohols, glycol ether esters, alkanes and turpenes. Preferred bipolar solvents include C3–C16 alcohols and/or ethoxylated alcohols possessing from 0–6 ethylene oxide residues, C2–C10 esters of mono-, di-, and tri-glycol ethers, C8–C16 alkanes, and turpenes (e.g., turpentine, dipentene, and alpha-pinene). More preferred bipolar solvents include ethoxylated monohydric alcohols such as ALFONIC 6-3 (C6 normal monohydric alcohol condensed with 3 moles of ethylene oxide, commercially available from Vista Chemical Company) and ALFONIC 810-2 (C8–C10 mixed normal monohydric alcohol condensed with 2 moles of ethylene oxide, commercially available from Vista Chemical Company), 2-ethyl hexanol, methanol, ethanol, butanol, isobutanol, isopropyl alcohol, and mixtures thereof.

During the cooling phase, a high polarity solvent may be added to the polymer/bipolar solvent mixture to develop the suspension, but the use of a high polarity solvent is not always required. High polarity solvents that may be used to develop the polymeric suspension by increasing the inter-particle distance and density of the blend include but are not limited to diethylene glycol, butanol, isobutanol, 2-ethyl hexanol, butyl carbitol and butyl cellosolve. Diethylene glycol is the most preferred high polarity solvent for use with a polymer/bipolar solvent mixture comprising ethylene vinyl acetate copolymers solvated in ethoxylated monohydric alcohols. However, the selection of the appropriate high polarity solvent will depend largely on the types of wax crystal modifiers used, as well as the range of solubility parameters, hydrogen bonded characteristics, and densities that are necessary for the formation of highly dispersed and finely divided polymer particles.

The selection of bipolar and polar solvents useful in the present invention is aided by the use of published solubility parameter, hydrogen bonding, and density values for many commercially available solvents (e.g., CRC Handbook of Chemistry and Physics). It is assumed that these properties are additive and that specific or targeted solubility parameter, hydrogen bonding, and density values can be approximately calculated to produce a solvent mixture suitable for the formation of a stable suspension. Solubility plots are created by blending polymers with various solvents and plotting solubility parameters versus hydrogen bonding and density values. Since the formation of stable polymeric suspensions is the goal, the solubility parameter, hydrogen bonding, and density values must fall outside the polymer or copolymer solubility range. One may predict where these areas of polymer and/or copolymer insolubility occur by multiplying the individual solvent component's solubility parameter, hydrogen bonding, and density values by their fractional weight composition within the mixture and summing the resulting products to obtain approximate values for the mixtures. The goal is to produce a solvent mixture that possesses the appropriate solubility parameter and hydrogen bonding values to place the polymer outside its area of solubility, while achieving a mixture density capable of producing a stable suspension.

In general, 2 to 30% weight wax crystal modifier is dissolved in 5 to 55% weight bipolar solvent. In a preferred embodiment, 10 to 25% weight wax crystal modifier is dissolved in 35 to 50% weight bipolar solvent. In a more preferred embodiment, 15 to 25% weight wax crystal modifier is dissolved in 40 to 50% weight bipolar solvent. Once the wax crystal modifier has been dissolved in the bipolar solvent at elevated temperatures, the polymer/solvent mixture is allowed to cool to ambient temperature with vigorous mixing. When a high polarity solvent is used, typically 5 to 50% weight high polarity solvent is added. In a preferred embodiment, 25 to 45% weight high polarity solvent is added, and in a more preferred embodiment, 30 to 45% weight high polarity solvent is added. Alternatively, a higher % weight bipolar solvent or combination of solvents may be used in place of the high polarity solvent. In certain embodiments, aromatic solvents such as xylene and toluene may also be used. Surfactants such as sorbitan monooleate, sorbitan monopalmitate, and sodium xylene sulfonate may be added to the bipolar or polar solvent to help disperse the wax crystal modifier particles. Suspending agents or viscosifiers may also be used. A preferred viscosifier is polyvinyl pyrrolidone.

In one embodiment, ethylene vinyl acetate (EVA) is dissolved at elevated temperature in a bipolar solvent mixture comprising an ethoxylated monohydric alcohol such as ALFONIC 6-3 (C6 normal monohydric alcohol condensed with 3 moles of ethylene oxide, commercially available from Vista Chemical Company) and dipentene. In a preferred embodiment, about 2–30% weight, more preferably about 15–20% weight EVA is used. In a preferred embodiment, about 5–50% weight bipolar solvent mixture is used, preferably comprising about 4–50% weight, more preferably about 45% weight ALFONIC 6-3 and about 2–20% weight, more preferably about 15% weight dipentene. The rate of dissolution may be improved by the application of heat in the range from about 220° F. to 350° F. and vigorous mixing. Once the EVA is dissolved, the mixture is cooled with vigorous mixing. When the mixture has reached a temperature of approximately 125° F., normal butanol is slowly added and the mixture is allowed to cool with vigorous mixing. In a preferred embodiment, about 3–25% weight, more preferably about 20% weight butanol is used. A polar development solvent comprising diethylene glycol is added at a temperature of approximately 90° F., and vigorous mixing is continued as the product is cooled to ambient temperature. In a preferred embodiment, about 5–30% weight diethylene glycol is used. The final product exhibits excellent paraffin wax inhibition properties and a low pour point.

In another embodiment, EVA is dissolved at elevated temperature in a bipolar solvent mixture comprising C8–C10 normal alcohol condensed with 3.5 moles of ethylene oxide and 2-ethyl-hexanol. In a preferred embodiment, about 2–30% weight, more preferably about 15–20% weight EVA is used. In a preferred embodiment, about 5–50% weight bipolar solvent mixture is used, preferably comprising about 514 50% weight, more preferably about 45% weight ALFONIC 810-2 and about 2–40% weight, more preferably about 35% weight 2-ethyl-hexanol. The rate of dissolution may be improved by the application of heat in the range from 250° F. to 350° F. and vigorous mixing. Once the EVA is dissolved, the mixture is cooled with vigorous mixing. When the mixture has reached a temperature of approximately 135° F., a polar development solvent comprising diethylene glycol is added. In a preferred embodiment, about 5–30% weight diethylene glycol is used. Vigorous mixing is continued as the product is cooled to ambient temperature. The final product exhibits excellent paraffin wax inhibition properties and a low pour point.

In another embodiment, two EVA copolymers possessing different ratios of vinyl acetate to ethylene and different molecular weights are blended to form an EVA mixture. The EVA mixture is dissolved at elevated temperature in a bipolar solvent mixture comprising an ethoxylated monohydric alcohol such as ALFONIC 6-3 (C-6 normal monohydric alcohol condensed with 3 moles of ethylene oxide, commercially available from Vista Chemical Company) and butyl carbitol. In a preferred embodiment, about 2–40% weight, more preferably about 15–30% weight total EVA is used. In a more preferred embodiment, about 15% weight EVA (M.W. 140,000 daltons) comprising 35% vinyl acetate and 65% ethylene is used in combination with about 15% weight EVA (M.W. 170,000 daltons) comprising about 18% vinyl acetate and 82% ethylene. In a preferred embodiment, about 5–75% weight bipolar solvent mixture is used, preferably comprising about 4–75% weight, more preferably about 40% weight ALFONIC 6-3 and about 2–70% weight, more preferably about 60% weight butyl carbitol. The rate of dissolution may be improved by the application of heat in the range from 250° F. to 350° F. and vigorous mixing. Once the EVA mixture is dissolved, the mixture is cooled to ambient temperature with vigorous mixing until smooth with a milky-white appearance. The final product exhibits excellent paraffin wax inhibition properties and a low pour point.

In another embodiment, EVA is dissolved at elevated temperature in a solvent mixture comprising an ethoxylated monohydric alcohol possessing a bipolar character and an acylated monohydric alcohol. The solvent mixture may comprise ALFONIC 6-3 (C-6 normal monohydric alcohol condensed with 3 moles of ethylene oxide, commercially available from Vista Chemical Company) and acylated C6–C12 monohydric alcohol such as EXXATE (e.g., EXXATE 600, EXXATE 800 and EXXATE 1300, each commercially available from EXXON). In a preferred embodiment, about 2–30% weight, more preferably about 15–20% weight EVA is used. In a preferred embodiment, about 5–50% weight bipolar solvent mixture is used, preferably comprising about 4–50% weight, more preferably about 45% weight ALFONIC 6-3 and about 2–20% weight, more preferably about 15% weight EXXATE. The rate of dissolution may be improved by the application of heat in the range from 220° F. to 350° F. and vigorous mixing. Once the EVA is dissolved, the mixture is cooled with vigorous mixing. When the mixture has reached a temperature of approximately 125° F., isobutanol is slowly added. In a preferred embodiment, about 3–25% weight, more preferably about 20% weight isobutanol is used. The mixture is allowed to cool with vigorous mixing until the formation of a gel is observed. Vigorous mixing is continued and the product cooled to ambient temperature. The final product exhibits excellent paraffin wax inhibition properties and a low pour point.

In yet another embodiment, maleic olefin and acrylate polymers are dissolved in a highly aliphatic and consistent quality solvent (e.g., KERMAC 600, commercially available from Calumet Lubricants Co.) to solvate the crystal modifier particles. In a preferred embodiment, about 4 to 35% weight, more preferably about 15 to 17% weight maleic olefin is used in combination with about 0.5 to 8% weight, more preferably about 2 to 5% weight acrylate. Sufficient aliphatic solvent is used to reduce the solution viscosity to a level that affords vigorous mixing. The three ingredients are mixed thoroughly while heating to a temperature of 120° F. to 160° F. (i.e., above the melting point of the polymers) until a homogenous and clear solution is achieved. A bipolar solvent, preferably isopropyl alcohol, is then added to the solution with vigorous mixing The amount of IPA used determines the pour point of the finished product, and in general, the more IPA used, the lower the pour point of the finished product. In a preferred embodiment, about 30 to 90% weight, more preferably 50 to 60% weight IPA is used. Surfactants such as sorbitan monopalmitate and ethoxylated polyhydric alcohol may be used to improve the suspension characteristics of the dispersion. In a preferred embodiment, about 0.5 to 5% weight, more preferably about 1 to 3% weight sorbitan monopalmitate may be used, while about 2 to 10% weight, more preferably about 3 to 5% weight ethoxylated polyhydric alcohol may be used. The final product exhibits excellent paraffin wax inhibition properties and a low pour point.

EXAMPLE 1

A polymer mixture comprising 10% weight ELVAX 150 (ethylene vinyl acetate polymer, commercially available from DuPont) and 10% weight ELVAX 450 (ethylene vinyl acetate polymer, commercially available from DuPont) was dissolved in a solution comprising 40% weight ALFONIC 6-3 (C6 normal monohydric alcohol condensed with 3 moles of ethylene oxide, commercially available from Vista Chemical Company), 20% weight 2-ethyl hexanol, and 20% butanol. The resulting mixture was heated to 320° F. and maintained at temperature for 1 hour, then cooled to room temperature (68° F.) with vigorous mixing until a suspension was formed. The suspension had a pour point between −10° and 0° F., exhibited no separation after 10 days, and remained stable for at least six months at 130° F.

EXAMPLE 2

A polymer mixture comprising 4.5% weight ELVAX 150 (ethylene vinyl acetate polymer, commercially available from DuPont) and 13.5% weight ELVAX 450 (ethylene vinyl acetate polymer, commercially available from DuPont) was dissolved in a solution comprising 42% weight ALFONIC 6-3 (C6 normal monohydric alcohol condensed with 3 moles of ethylene oxide, commercially available from Vista Chemical Company) and 20% weight butyl carbitol. The resulting mixture was heated to 320° F. and maintained at temperature for 1 hour, then cooled to room temperature (68° F.) with vigorous mixing. When the mixture reached a temperature of approximately 135° F., 20% weight isobutanol was added and mixing was continued until a suspension was formed. The suspension had a pour point between −10° and 0° F., exhibited no separation after 10 days, and remained stable for at least six months at 130° F.

EXAMPLE 3

11.87 pounds (11.69% weight) ELVAX 150 (ethylene vinyl acetate polymer, commercially available from DuPont), 16.74 pounds (16.48% weight) of kerosene, and 4.98 pounds (4.9% weight) of butyl cellosolve were mixed until in solution. Next, 1.04 pounds (1.02% weight) of SPAN 80 (sorbitan monooleate, commercially available from ICI) were added. With maximum mixing, 65.93 pounds (64.92% weight) of isopropyl alcohol were slowly added to the mixture. Finally, 1.00 pounds (0.98% weight) of PVVP K-90 (polyvinyl pyrrolidone, commercially available from ISP) were added, and the resulting suspension was mixed for 1½ hours.

The resulting suspension remained fluid at temperatures ranging from −40° F. to 120° F. However, the suspension became unstable when heated above 120° F. for 1 hour, as the polymer began to precipitate and the emulsion separated. On average, the suspension exhibited less than 2% by volume particle separation after 1–2 days at room temperature (68° F.).

EXAMPLE 4

15 pounds (15.01% weight) ELVAX 150 (ethylene vinyl acetate polymer, commercially available from DuPont) was dissolved in a mixture comprising 44.95 pounds (44.98% weight) of ALFONIC 6-3 (C6 normal monohydric alcohol condensed with 3 moles of ethylene oxide, commercially available from Vista Chemical Company) and 15.06 pounds (15.07% weight) dipentene. The solution was heated to 300° F. and maintained at temperature with vigorous mixing for about 2–4 hours or until the polymer was dissolved. The mixture was then cooled with vigorous mixing. When the mixture reached a temperature of 125° F., 19.26 pounds (19.27% weight) of normal butanol was slowly added, and vigorous mixing continued until the mixture had a smooth and even consistency (i.e., no lumps or grit). The mixture was then cooled to 90° F., and 5.67 pounds (5.67% weight) diethylene glycol was slowly added to develop the blend.

The resulting suspension remained fluid at temperatures ranging from −40° F. to 100° F. and exhibited no separation after 2 months at room temperature (68° F.).

EXAMPLE 5

15 pounds (15% weight) ELVAX 450 (ethylene vinyl acetate polymer, commercially available from DuPont) was dissolved in a solvent mixture comprising 30 pounds (30% weight) ALFONIC 810-2 (C8–C10 mixed normal monohydric alcohol condensed with 2 moles of ethylene oxide, commercially available from Vista Chemical Company) and 35 pounds (35% weight) 2-ethyl-hexanol. The polymer/solvent mixture was heated to 300° F. and maintained at temperature with vigorous mixing for about 2–4 hours or until the polymer was dissolved. The mixture was then cooled with vigorous mixing. When the mixture reached a temperature of 140° F., 20 pounds (20% weight) diethylene glycol was slowly added to develop the blend.

The resulting suspension remained fluid at temperatures ranging from −40° F. to 160° F. The suspension exhibits no separation after 2 months at room temperature (e.g., 68° F.).

EXAMPLE 6

A polymer mix comprising 5 pounds (7.04% weight) ELVAX 170 (ethylene vinyl acetate polymer, commercially available from DuPont) and 16 pounds (22.54% weight) ELVAX 450 (ethylene vinyl acetate polymer, commercially available from DuPont) was dissolved in a solvent mixture comprising 20 pounds (28.17% weight) ALFONIC 6-3 (C6 normal monohydric alcohol condensed with 3 moles of ethylene oxide, commercially available from Vista Chemical Company) and 30 pounds (42.25% weight) butyl carbitol. The polymer/solvent mixture was heated to 300° F. and maintained at temperature with vigorous mixing for about 1–3 hours or until the polymer was dissolved. The mixture was then cooled to a temperature of about 70° F. with vigorous mixing. Once the mixture had a milky white appearance and a viscosity of about 100 centipoise, it was filtered through a fine mesh screen to remove any large particles.

The resulting suspension remained fluid at temperatures ranging from −40° F. to 160° F. and exhibited no separation after 2 months at room temperature (68° F.).

EXAMPLE 7

12 pounds (12.77% weight) of ELVAX 450 (ethylene vinyl acetate polymer, commercially available from DuPont) was dissolved in a solvent mixture comprising 30 pounds (31.91% weight) of EXXATE 1300 (acylated C6–C12 monohydric alcohol commercially available from Exxon) and 20 pounds (21.28% weight) of ALFONIC 6-3 (C6 normal monohydric alcohol condensed with 3 moles of ethylene oxide, commercially available from Vista Chemical Company). The polymer/solvent mixture was heated to 300° F. and maintained at temperature with vigorous mixing for about 1–3 hours or until the polymer was dissolved. The mixture was then cooled to about 136° F., and 32 pounds (34.04% weight) of isobutanol was slowly added with vigorous mixing. Once the mixture had a milky white appearance and a viscosity of about 100 centipoise, it was filtered through a fine mesh screen to remove any large particles.

The resulting suspension remained fluid at temperatures ranging from −40° F. to 160° F. and exhibited no separation after 2 months at room temperature (68° F.).

EXAMPLE 8

52.976 pounds (14% weight) of PD 101 (maleic olefin, commercially available from P-Chem) and 14.152 pounds (3.74% weight) of ACRYLOID 154-70 (acrylate, commercially available from Romax) were dissolved in 18.542 pounds (4.9% weight) of KERMAC 600 (petroleum hydrocarbon distillate, commercially available from Calumet Lubricants Co.). The polymer/aliphatic solvent mixture was heated to 120–140° F. until the solution was homogenous and clear. In a separate vessel, 5.298 pounds (1.4% weight) of SPAN 40 (sorbitan monopalmitate, commercially available from ICI), 10.595 pounds (2.8% weight) of ATSURF T-80 (ethoxylated polyhydric alcohol, commercially available from ICI) and 140.613 pounds (37.16% weight) of isopropyl alcohol were mixed together then added to the polymer/aliphatic solvent solution at a rate of 30 gal/min. The resulting mixture was stirred continuously for 20 minutes, and 136.224 pounds (36% weight) xylene was added with mixing.

The resulting wax crystal modifier suspension had a pH of 4.98 and a density of 6.96. The suspension remained fluid at temperatures ranging from −10° to 160° F. and did not exhibit any particle separation of three weeks at room temperature (68° F.).

What is claimed is:

1. A method of winterizing wax crystal modifiers, comprising the steps of:

mixing at least one polymeric wax crystal modifier and a bipolar solvent, wherein said bipolar solvent is selected from the group consisting of alcohols, ethoxylated alcohols, glycol ether esters, and terpenes;

heating said polymeric wax crystal modifier and bipolar solvent to a temperature of about 150° to 350° F. to solvate the polymeric wax crystal modifier and form a solution; and cooling said solution with mixing to form a suspension of finely divided wax crystal modifiers that remains fluid at temperatures of about −40° to 160° F.

2. The method of claim 1, wherein said polymeric wax crystal modifier comprises at least one acrylate or methacrylate polymer having a pendant group of C10 to C50.

3. The method of claim 1, wherein said polymeric wax crystal modifier comprises at least one polymer with repeating saturated carbon chain segments of $C_{20}H_{41}$ to $C_{50}H_{101}$ .

4. The method of claim 1, wherein said polymeric wax crystal modifier comprises ethyl vinyl acetate or ethyl vinyl acetate copolymers.

5. The method of claim 1, wherein about 2–30% weight polymeric wax crystal modifier is solvated in about 5–55% weight bipolar solvent.

6. The method of claim 1, further comprising adding to said polymeric wax crystal modifier and bipolar solvent a high polarity solvent comprising diethylene glycol, butanol, isobutanol, 2-ethyl hexanol, butyl carbitol or butyl cellosolve.

7. The method of claim 6, wherein said high polarity solvent comprises about 5 to 50% weight.

8. The method of claim 1, wherein said bipolar solvent comprises ethoxylated monohydric alcohol.

9. The method of claim 1, wherein said solvent is selected on the basis of solubility parameter, hydrogen bonding and density required to effect micellarization without chemical reaction.

10. A method of winterizing wax crystal modifiers, comprising the steps of:

mixing at least one acrylate or methacrylate polymer having a pendant group of C10 to C50 and an aliphatic solvent with heating to form a solution; and adding to said solution a bipolar solvent in an amount sufficient to form a suspension of finely divided wax crystal modifiers which remains fluid at temperatures of about −40° to 160° F.

11. The method of claim 10, wherein at least one of said acrylate or methacrylate polymer comprises maleic olefin.

12. The method of claim 10, wherein said aliphatic solvent is selected on the basis of solubility parameter, hydrogen bonding and density required to effect micellarization without chemical reaction.

13. A method of inhibiting the formation of wax crystal precipitates in crude oil or petroleum fuel, comprising the steps of:

mixing at least one polymeric wax crystal modifier and a bipolar solvent, wherein said bipolar solvent is selected from the group consisting of alcohols, ethoxylated alcohols, glycol ether esters, alkanes and terpenes;

heating said polymeric wax crystal modifier and bipolar solvent to a temperature of about 150° to 350° F. to solvate the polymeric wax crystal modifier and form a solution;

adding a high polarity solvent with mixing to form a suspension of finely divided wax crystal modifiers that remains fluid at temperatures of about −40° to 160° F., wherein said high polarity solvent comprises diethylene glycol, butanol, isobutanol, 2-ethyl hexanol, butyl carbitol or butyl cellosolve; and contacting said suspension with crude oil or petroleum fuel to disrupt the formation of paraffin wax crystals.

14. The method of claim 13, wherein said polymeric wax crystal modifier comprises ethyl vinyl acetate copolymer.

15. The method of claim 13, wherein said bipolar solvent comprises ethoxylated monohydric alcohol.

16. The method of claim 13, wherein said bipolar solvent is selected on the basis of solubility parameter, hydrogen bonding and density required to effect micellarization without chemical reaction.

17. A The method of claim 13, wherein said high polarity solvent is selected on the basis of solubility parameter, hydrogen bonding and density required to effect micellarization without chemical reaction.

18. The method of claim 1, wherein said polymeric wax crystal modifier and bipolar solvent are heated to a temperature of about 330 to 350° F. to solvate the polymeric wax crystal modifier and form a solution.

19. The method of claim 13, wherein said polymeric wax crystal modifier and bipolar solvent are heated to a temperature of about 330° to 350° F. to solvate the polymeric wax crystal modifier and form a solution.

* * * * *